United States Patent [19]

Haim et al.

[11] Patent Number: 4,916,352

[45] Date of Patent: Apr. 10, 1990

[54] JACKETED FLUORESCENT LAMPS

[75] Inventors: Elias S. Haim, Windham, N.H.; Frank W. McGlasson, Tewksbury, Mass.

[73] Assignee: General Electric Company, Burlington, Mass.

[21] Appl. No.: 268,124

[22] Filed: Nov. 7, 1988

[51] Int. Cl.[4] ..... H01J 17/16; H01J 61/34

[52] U.S. Cl. ..... 313/25; 313/493

[58] Field of Search ..... 313/25, 35, 36, 493

[56] References Cited

U.S. PATENT DOCUMENTS 2,300,892 11/1942 Harada et al. ..... 313/36 X

*Primary Examiner*—Sandra L. O'Shea

*Attorney, Agent, or Firm*—I. David Blumenfeld; Fred Jacob; Robert A. Cahill

[57] ABSTRACT

A fluorescent lamp structure having a light transparent jacket surrounding the lamp. The chamber between the lamp and jacket is filled with a fluid (or mixture of fluids) which transitions between the liquid and vapor phases. The fluid extracts heat when the lamp wall temperature rises above a predetermined temperature causing the fluid to vaporize. The fluid condenses to form a partial vacuum in the chamber below that temperature.

2 Claims, 1 Drawing Sheet

JACKETED FLUORESCENT LAMPS

This invention relates to a light source for a transmissive Liquid Crystal Display and, more particularly, to a jacketed fluorescent light source for controlling the lamp wall temperature over a wide temperature range.

BACKGROUND OF THE INVENTION

Flat Panel Liquid Crystal Displays typically include a light source illuminating the Liquid Crystal Display. In many instances, and particularly where Liquid Crystal Displays are used in a cockpit of an aircraft, the display must be viewed under very high ambient light levels which may be as high as 10,000 ft-lamberts. In order to be visible at these ambient brightness levels the brightness level of the display must also be very high −2000 ft lamberts or more. Fluorescent lamps are very useful for this application as their efficiency as well as their output is very high and can easily reach 2000 to 4000 ft lamberts. Fluorescent lamps, typically include a filler gas mixture of mercury vapor and a rare gas such as argon. The mercury vapor emits ultra violet radiation which excites the phosphor deposited on the inner surface of the lamp wall to produce light in the spectrum.

Fluorescent lamps are, however, temperature sensitive and the lamp filler gas and the phosphor operates at optimum efficiency with a wall temperature between 40° and 50° C. (i.e., 104° to 122° F.). The light output drops off rapidly outside of this optimum temperature range and at very low temperatures (i.e., −30°−50° C.), fluorescent lamps are essentially inoperative. Liquid Crystal Displays when utilized in aircraft applications, may often be subjected to extremely low ambient temperature conditions. For example, it is not uncommon in aircraft applications (where aircraft may be parked overnight in extreme cold) for the ambient temperature to be as low as −20° or −30° C. Operation at these extremely low temperatures introduces problems for fluorescent light sources which are otherwise prime candidates because of their high brightness and their high efficiencies.

In the past, it has been proposed to use heating elements wound around the fluorescent lamp to maintain the lamp wall temperature at the desired level for maximum brightness. In such a system a temperature sensor located in the vicinity of the lamp controls a power supply which drives current through the heaters to maintain the wall temperature of the fluorescent lamps at the desired level. However, the use of heaters, sensors, signal processors and power supplies add cost, and complexity, to the system and require additional space. A need exists for a different and more effective way of maintaining the wall temperature, and hence the light output, of a fluorescent lamp at the desired optimal level even at low ambient temperatures.

In a fluorescent lamp approximately 21% of the input energy is converted into visible light either directly or through the U.V. conversion processes and the remaining 79% is converted to heat; 42% is dissipated directly and 37% is dissipated in the form of infrared radiation.

Applicant has discovered a system in which a portion of the heat dissipated by the lamp is utilized to maintain the lamp wall temperature at the desired level. This is achieved by providing a jacket around the lamp which contains a fluid (or mixture of fluids), which is selectively evaporated and condensed to maintain the lamp wall temperature in the optimum temperature range. At low temperatures fluid in the vapor phase condenses to form a partial vacuum in the jacket around the lamp. The vacuum minimizes convectional, and conductive heat losses from the lamp and raises the temperature of the wall toward the optimal conditions even though the ambient temperature outside of the jacket is much lower.

As the wall temperature rises above the desired optimal level, the fluid (or mixture of fluids) in the liquid phase is vaporized to extract heat from the wall, both by means of the latent heat of vaporization of the fluid as it changes from the liquid to the vapor phase and then through heat transfer through the vapor in the jacket. Thus, above the critical temperature range heat is removed from the fluorescent lamp wall to the vapor and thence to the outer wall of the jacket. At very low temperatures all of the fluid condenses to the liquid phase forming a vacuum.

Suitable mixtures of material such as bromine, alcohol, water, etc. may be used in suitable proportions to establish the desired transition or vaporization temperature at which the fluid vaporizes to remove heat and maintain the wall temperature.

OBJECTIVES OF THE INVENTION

It is therefore a principal objective of the invention to provide a jacketed fluorescent lamp assembly to maintain the fluorescent lamp wall at optimum temperature.

Another objective of the invention is to provide a jacketed fluorescent lamp assembly in which vaporization and condensation of a fluid or mixture of fluids in the chamber formed between the lamp and the jacket aids in removing the heat from the fluorescent lamp wall at high temperatures and prevents extraction of heat from the lamp wall at very low temperatures.

Yet another objective of the invention is to provide a jacketed fluorescent lamp having higher efficiency and brighter output than possible at the ambient temperature by controlling the fluorescent wall temperature.

Still other objectives and advantages of the invention will become apparent as the description thereof proceeds.

SUMMARY OF THE INVENTION

The objectives and advantages of the invention are realized in a fluorescent lamp assembly which has a glass jacket fused to the outer wall of the fluorescent lamp to provide a chamber which is filled with a fluid or mixture of fluids which will maintain the wall temperature at the desired level by acting as a heat transfer medium. At high temperatures the fluid extracts heat from the lamp wall through both the latent heat of evaporation as the fluid changes phases and by heat transfer through the vapor. The fluid prevents loss of heat from the wall at low temperatures by condensing to a liquid phase forming a vacuum in the chamber.

DETAILED DESCRIPTION OF THE INVENTION

Figure 1:
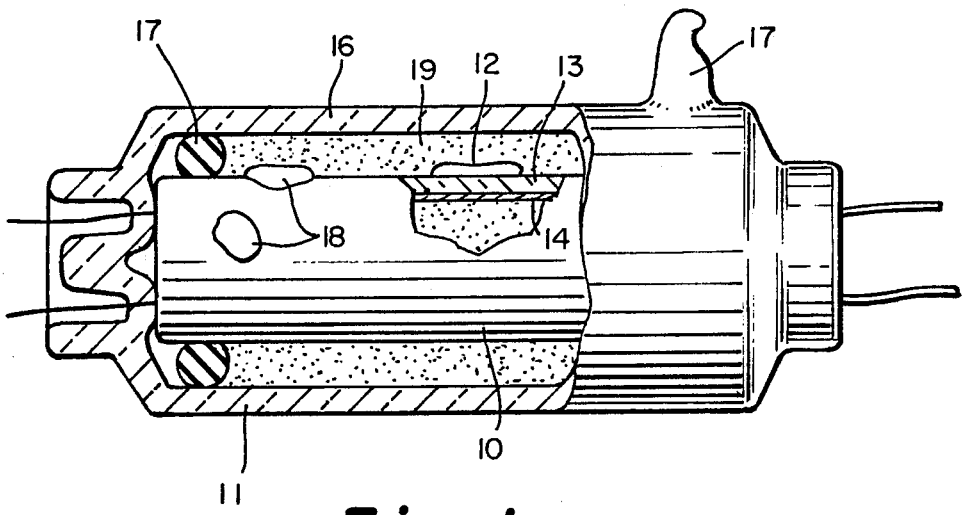
FIG. 1 is a schematic, partially in section and partially broken away, of the jacketed fluorescent lamp.

FIG. 1 shows a fluorescent lamp 10 which is surrounded by and is fused to a light transmissive glass jacket 11 to form a chamber 12 surrounding the outer wall of the fluorescent lamp. The fluorescent lamp is shown broken away to show lamp housing 13 which has, as is customary in all fluorescent lamps, a thin layer of phosphor 14 deposited on the inner surface. The filler gas mixture in the fluorescent lamp housing is a combination of mercury vapor and a rare gas such as argon. The mercury vapor emits ultra violet radiations which excite the phosphor which emits light in the visible spectrum. Only 21% of the energy input to a fluorescent lamp is emitted in the form of a visible light the remaining 79% of the input energy is dissipated directly as heat or a form of infrared radiation and it is the 79% of the energy that is utilized in conjunction with the glass jacket to control the wall temperature of the fluorescent lamp to maintain at or near its optimum conditions. Filler tube 15 extends through glass wall 16 and is the means through which the fluid or mixture of fluids is introduced into the chamber 12 formed between the outer wall of the fluorescent lamp and the glass jacket. Positioned at each end of the chamber 12 is an O-ring 17, only one of which is shown, which, with wall 16, define the chamber and block the fluids from the ends of the jacket.

The fluid or mixture of fluids inside of the chamber are shown in FIG. 1 as a combination of a fluid 18 in the liquid phase and fluid 19 in the vapor phase. Depending on the temperature and the fluid characteristic, all or part of the fluids may be in the liquid phase or all or part may be in the vapor phase or a combination of the two as illustrated in FIG. 1. A mechanism by which the fluids, in whatever phase, control or modify the wall temperature of the fluorescent lamp is dependent on the fluids utilized, the transitional temperature of the fluid or a combination of fluids; i.e., temperature at which they change from the liquid to the vapor phase and conversely from the vapor to the liquid phase. Thus, depending on the selected wall temperature for maximum or optimum output conditions, the fluid or mixture of fluids is selected. Table I below shows a number of fluids having transitional temperatures between 40° and 50° C. Table 1 identifies these fluids, the transition temperatures and latent heats of vaporization. Latent heat of vaporization is the quantity of heat in calories/gram or BTU/LB. required to convert a unit quantity of the fluid at a definite temperature to a vapor at the same temperature. Conversely, the heat of condensation of such a vapor, i.e., the heat emitted by the vapor as it is converted from the vapor phase to the liquid phase at the same temperature, is equal to the latent heat of vaporization.

TABLE I

| FLUID | Latent Heat of TRANSITION TEMPERATURE (°C.) | Latent Heat of Evaporation (cal/Gm) |
|---|---|---|
| | | Bromine (Br) |
| Bromine (Br) | 58.7 | 3.58 |
| Methyl Iodide ($CH_3I$) | 42 | 45.9 |

TABLE I-continued

| FLUID | Latent Heat of TRANSITION TEMPERATURE (°C.) | Latent Heat of Evaporation (cal/Gm) |
|---|---|---|
| Methylene Chloride ($CH_2I_2$) | 40.5 | 78.6 |
| Sulfur Trioxide ($SO_3$) | 53 | 118.5 |
| Ammonia (SAT) ($NH_3$) | 40 | 263 |

It will be obvious, that the individual fluids described in Table 1, all have transitional temperatures within the 40° to 50° C. range at which fluorescent lamp devices are at their optimum efficiency. Other fluids or mixtures may be utilized to provide higher heat transfer characteristics to maintain the fluorescent lamp wall temperature in the desired range upper temperature levels while at the same time, providing heat conservation function at very much lower temperatures as the fluid changes phase to provide the desired vacuum in the jacketed chamber.

Still other objectives and advantages of the invention will become apparent as the description thereof proceeds.

It will thus be apparent that a jacketed fluorescent lamp is very useful in controlling the temperature of the fluorescent lamp as the fluid between the lamp and the jacket changes phases to control heat transfer from the lamp.

While a particular embodiment of this invention has been shown, it will be understood that the invention is by no means limited thereto since many modifications may be made in the structural arrangement and in the instrumentalities employed. It is contemplated that the appended claims cover any such modifications as fall within the true spirit and scope of this invention.

What is claimed as new and is desired to be secured by U.S. Letters Patent is:

1. A light source comprising:

(a) a fluorescent lamp;

(b) a light transmissive jacket surrounding and fused to said fluorescent lamp and defining a sealed chamber surrounding said lamp;

(c) fluid means comprising a mixture of fluids retained in said chamber, said fluid means being selected to be in a liquid phase below a selected temperature to form at least a partial vacuum to reduce heat loss from the lamp, and in a vapor phase above said selected temperature to extract heat from the lamp wall.

2. A light source comprising:

(a) a fluorescent lamp;

(b) a light transmissive glass jacket surrounding said fluorescent lamp and being fused thereto and defining a sealed chamber surrounding said lamp;

(c) fluid means comprising a mixture of fluids retained in said chamber, said fluid means being selected to be in a liquid phase below a selected temperature to form at least a partial vacuum to reduce heat loss from the lamp, and in a vapor phase above said selected temperature to extract heat from the lamp wall.

* * * * *